United States Patent [19]

Kappas

[11] 4,070,984

[45] Jan. 31, 1978

[54] OUTBOARD MOTOR AND WEED GUARD THEREFOR

[76] Inventor: Chris S. Kappas, 218 - 13th St., Racine, Wis. 53403

[21] Appl. No.: 818,309

[22] Filed: July 25, 1977

[51] Int. Cl.[2] ..... B63H 5/16

[52] U.S. Cl. ..... 115/42

[58] Field of Search ..... 115/6.1, 17, 18 E, 42, 115/70

[56] References Cited

U.S. PATENT DOCUMENTS

| | | | |
|---|---|---|---|
| 662,522 | 11/1900 | Butterworth | 115/42 |
| 2,244,217 | 6/1941 | Fries | 115/42 |
| 3,035,538 | 5/1962 | Willard | 115/42 |
| 3,802,377 | 4/1974 | Porter et al. | 115/42 |
| 4,013,033 | 3/1977 | Porter et al. | 115/42 |

*Primary Examiner*—Trygve M. Blix
*Assistant Examiner*—Jesus D. Sotelo
*Attorney, Agent, or Firm*—James E. Nilles

[57] ABSTRACT

An outboard motor provided with a horizontally elongated marine propeller drive housing having a shaft journalled therein and a marine propeller mounted on the rear end of the shaft. A weed guard is mounted on said rear end of the housing and surrounds and encloses the propeller, the weed guard has a tubular section at its front end and attached to the housing, and the guard also includes a rearwardly and radially outwardly diverging tapered wall having a series of radially extending spokes which are relatively thin in circumferential direction as compared to their axial width. The guide also includes a cylindrical portion integrally connected with said tapered wall and disposed radially outwardly from and surrounding the propeller and extending rearwardly past the propeller. The cylindrical portion is perforated so as to be substantially open to permit the passage of water readily therethrough. The tubular section, the tapered wall and the cylindrical portion are integrally cast in a single piece, and a removable rear end plate is attached to the rear end of the cylindrical portion and extends across the cylindrical portion in a transverse direction. The end plate is formed by a series of concentric rings which define a series of arcuate slots circumferentially spaced around and between each adjacent pair of concentric rings.

11 Claims, 6 Drawing Figures

OUTBOARD MOTOR AND WEED GUARD THEREFOR

BACKGROUND OF THE INVENTION

Weed or safety guards for outboard motors are well known and are usually necessary for use in trolling motors for boats where maneuvering in shallow or obstructed water is necessary. These guards have taken various forms and examples of such are shown in the U.S. Pat. Nos. 4,013,033 issued Mar. 22, 1977 to Porter et al; 3,035,538 issued May 22, 1962 to Willard; 2,244,217 issued June 3, 1941 to Pries; and 3,802,377 issued Apr. 9, 1974 to Porter et al.

In guards of this character it is necessary that the flow of water is unimpeded and the action of the propeller is unimpaired, but at the same time it is necessary to protect the propeller as much as possible from obstructions and entanglement in weeds. As a result, it has heretofore been difficult to retain complete efficiency of the propeller, completely protecting the propeller on all sides and yet permit easy maintenance, repair or replacement of parts such as the propeller or its shear pin. Some of these prior art devices have been made of rather fragile or resilient material so as to reduce the shock loads thereon when striking an obstruction, but this construction has resulted in damage to the guard and need for frequent replacement thereof. Other guards have been made of heavy and strong material, but have resulted in impairment of the passage of water and action of the propeller. Still other guards have not permitted easy access to the propeller and its shear pin that must be repaired or replaced. Trolling motors of the type to which the present invention pertains are also shown in my U.S. Pat. No. 3,906,887 which issued Sept. 23, 1975 and entitled "Electric Outboard Motor".

SUMMARY OF THE INVENTION

The present invention provides a guard for the propeller drive housing and which guard completely encloses the propeller and is readily attached to the drive housing, permits substantially uninhibited passage of the water into and out of the guard, permits efficient operation of the propeller, and is lightweight and strong in construction. More specifically, the guard includes a front rearwardly and outwardly tapering wall comprised of a series of radially extending and circumferentially spaced spokes which are relatively thin in circumferential direction as compared with their axial width; the guard also includes a cylindrical, perforated portion attached to the outer periphery of the tapered wall and which cylindrical portion is in axial alignment of the propeller and completely surrounds the latter; the guard also includes a perforated rear plate extending across the rear end of the cylindrical portion and located rearwardly across the propeller so as to fully protect the latter.

A more specific aspect of the invention relates to the particular form of the rear plate that includes a series of concentric rings each defining circumferentially spaced arcuate slots, the slots between adjacent pairs of concentric rings being circumferentially staggered with respect to one another.

The tubular attaching portion, the tapered front wall and the cylindrical portion of the guard are all formed of lightweight material and cast as an integral unit. The rear wall of the guard is ready removable from the cylindrical portion for easy access to the propeller and its shear pin for repair of replacement thereof.

These and other objects and advantages of the present invention will appear hereinafter as this disclosure progresses, reference being had to the accompanying drawings.

DESCRIPTION OF A PREFERRED EMBODIMENT

Figure 1:
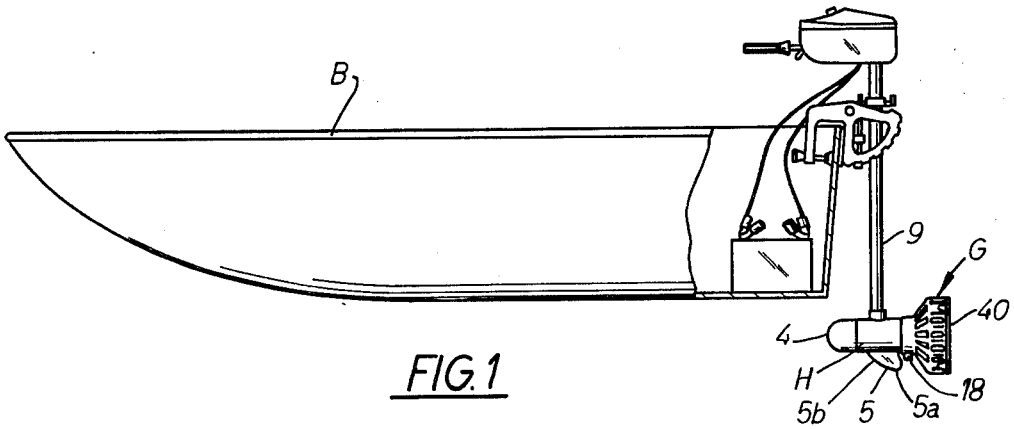
FIG. 1 is a side elevational view of a boat, partially broken away and showing the present invention mounted thereon.

A propeller drive housing H is of generally cylindrical form and has shaft S journalled therein and coaxial with said cylindrical housing and extending in a generally fore and aft direction with respect to the intended movement of the housing through the water. The housing includes a rear end 3 and a front end 4 both of which are generally semi-spherical in shape. A plate-like rudder 5 extends downwardly from said housing and radially outwardly to terminate in an outer, lower end **5*a*. The front edge 5*b* of the rudder is curved so as to permit passage of weeds to slide rearwardly without catching on the rudder, as the housing moves through the water. Intermediate the length of the housing extending upwardly from the elongated top housing is a tubular support portion 9 in which is mounted the electrical cords, not shown, that furnish power to the electric motor M within the housing. Thus, the support portion 9 depends downwardly from the boat B to which it is attached at its upper end in the conventional manner. A propeller P is removably secured to the rear end of the shaft S and can be removed therefrom by removing the pin 12**.

The weed guard G is mounted on the rear end of the housing and surrounds and encloses the propeller and comprises a front tubular section 16 at its front end and which section surrounds and embraces the rear end of the housing. The tubular section has a slit 17 extending along at least a portion of its length and a clamp 18 located partially on each side of the slot and has a threaded screw 19 extending through the clamp whereby tightening of the screw causes the tubular section to be clamped tightly on the housing. Thus, the entire guard can be easily attached to or removed from the housing, it being necessary first to remove the propeller, and remove screws 21 from lugs 23.

The weed guard also includes a rearwardly and outwardly diverging tapered wall 22 which is formed integrally with the tubular portion as being cast therewith of lightweight material. The tapered wall 22 terminates in a peripheral edge **22*a* and a cylindrical portion 24 is integrally connected with this radially outer rear edge 22*a* of the tapered wall 22** and is also formed integrally therewith as being cast with it. Thus, the tubular portion, the tapered wall, and the cylindrical portion are all cast together as a one-piece rigid unit.

The cylindrical portion 24 is disposed radially outwardly from the propeller P and surrounds the propeller and extends rearwardly of the propeller where it terminates in a circular rear end 26.

The cylindrical portion 24 is of such diameter that it extends approximately radially coextensive with the end 5*a* of the rudder, whereby weeds and the like can slide off the rudder and past the guard.

Figure 2:
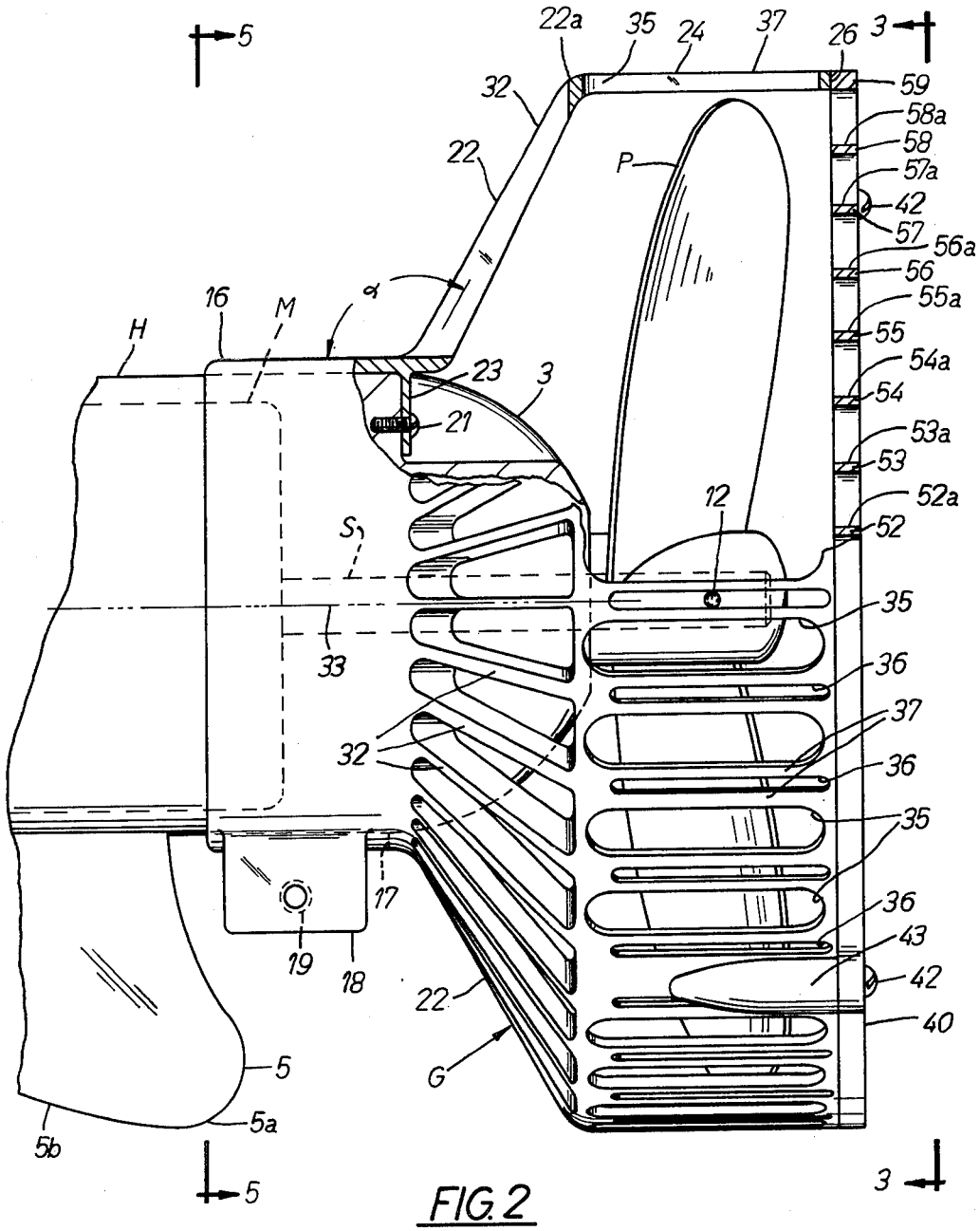
FIG. 2 is an enlarged, fragmentary view partially in section of a portion of the outboard motor and weed guard shown in FIG. 1.
Figure 3:
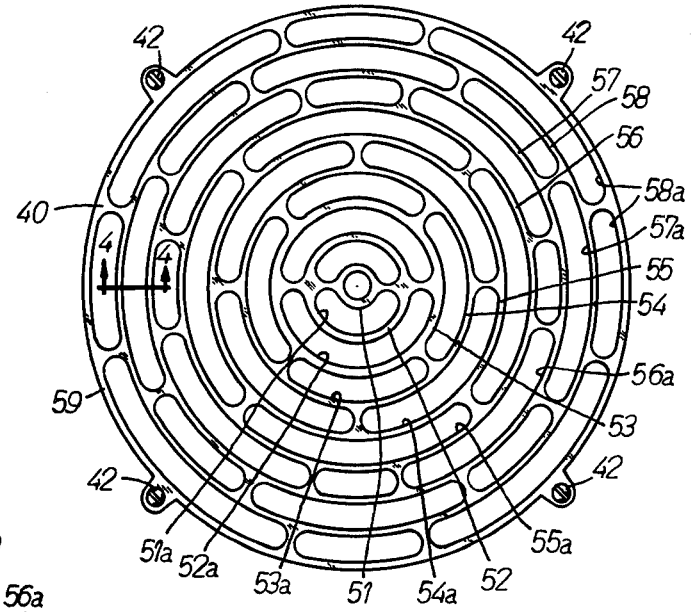
FIG. 3 is a view taken generally along the line 3—3 in FIG. 2, but on a reduced scale.
Figure 6:
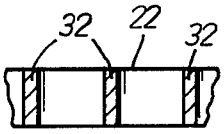
FIG. 6 is a view taken along the line 6—6 in FIG. 5, but on an enlarged scale
Figure 5:
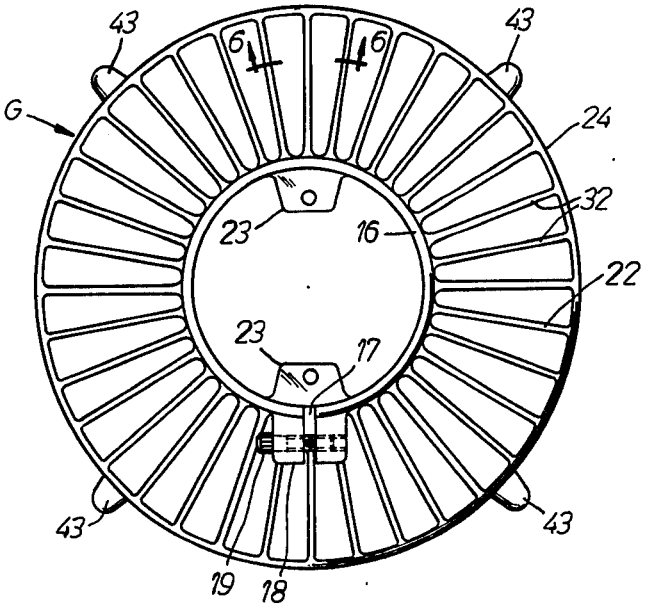
FIG. 5 is a view taken along the line 5—5 in FIG. 2, but on a reduced scale.

The tapered wall 22 is comprised of a series of radially extending spokes 32 which are relatively thin in circumferential direction as compared to their axial width as shown in FIG. 6. Furthermore, the tapered wall is inclined rearwardly with respect to the housing axis 33 at an angle of about 120 degrees, as indicated by the curvilinear arrow and in FIG. 2. With this construction and disposition of the tapered wall, the guard can be short in its axial length and, as the housing and guard move through the water, the water can pass from a front to rear direction readily through the tapered wall 22 with a minimum of turbulence and directly to the propeller P which in turn urges the water rearwardly to drive in the known manner.

The cylindrical portion 24 is perforated so as to be substantially open to permit passage of water readily therethrough with a minimum of turbulence so as not to impede the action of the propeller. More specifically, the cylindrical portion 24 includes a series of axially extending slots 35, circumferentially spaced therearound. Between each adjacent pair of slots 35 is located a narrower slot 36. These slots thus define a series of thin, elongated spokes 37 that extend in an axial, fore and aft direction.

A removable rear end circular plate 40 is attached to the rear end of the cylindrical portion 24 as by removable screws 42 that are threadably engaged in bosses 43 circumferentially spaced around the cylindrical portion 24. Thus, the end plate 40 can be readily removed from the cylindrical portion 24 of the guard, so that the propeller P can be removed from its shaft S and in turn permit removal of the guard G from the housing H. This facilitates repair or replacement of the propeller without removing the rest of the guard.

Figure 4:
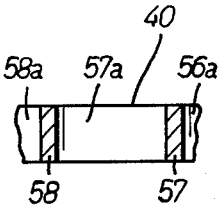
FIG. 4 is a sectional view taken along the line 4—4 in FIG. 3, but on an enlarged scale.

The removable rear end plate 40 extends completely across the cylindrical portion so as to completely enclose the propeller and prevent damage thereto or entanglement with weeds or the like. More specifically, the rear end plate is cast of lightweight material and comprises a series of concentric rings 51 through 59 and these rings have a series of arcuate slots 51*a* through 58*a* respectively, circumferentially spaced around and between each adjacent pair of concentric rings. It will also be noted that the arcuate slots located between any adjacent pair of rings are circumferentially off-set or staggered in respect to the radially adjacent slots of the adjacent pair of concentric rings. It will furthermore be noted that the concentric rings 51 through 58 are relatively thin in the radial direction as compared to their axial length, as shown in FIG. 4. With this construction and disposition of the rings and slots in the end plate, a maximum area of the plate is open to permit free passage of water through the plate with minimum turbulence, but at the same time a particularly rigid and strong plate 40 is provided.

RECAPITULATION

The guard provided by the present invention completely encloses the propeller, is axially short in length, permits free entry of water into the guard and free discharge of water out of the guard. The guard is particularly lightweight, has considerable strength and does not prohibit the propeller from efficiently performing its function.

I claim:

1. In combination with an outboard motor of the type having a horizontally elongated marine propeller drive housing and including a longitudinal front to rear axis, said housing having a front to rear extending shaft journalled therein and a marine propeller mounted on the rear end of said shaft, a weed guard mounted on said housing and surrounding and enclosing said propeller, said weed guard comprising a front end embracing said rear end of said housing for detachably securing said guard front end to said housing, said guard also including a rearwardly diverging tapered wall, said tapered wall comprising a series of radially extending spokes which are relatively thin in circumferential direction as compared to their front to rear width, whereby water can pass from a front to rear direction readily through said tapered wall, said guide also including a cylindrical portion integrally connected with said tapered wall and disposed radially outwardly from and surrounding said propeller and extending rearwardly past said propeller, said cylindrical portion being perforated to permit the passage of water readily therethrough; and a removable rear end plate attached to a rear end of said cylindrical portion and extending transversely behind said propeller, said plate being formed with a series of openings whereby said plate is substantially open to permit free passage of water therethrough.

2. The combination set forth in claim 1 further characterized in that said tapered wall extends radially outwardly and rearwardly at an angle of approximately 120° from the longitudinal front and rear axis of said housing.

3. The combination set forth in claim 1 further characterized in that said plate is formed by a series of concentric rings defining a series of arcuate slots circumferentially spaced between each adjacent pair of concentric rings, said arcuate slots between the pairs of adjacent concentric rings are circumferentially off-set from one another.

4. The combination set forth in claim 1 including a rudder extending radially outwardly from said drive housing and terminating at approximately the same radial distance as said cylindrical portion, whereby weeds and the like can slide off said rudder and past said guard.

5. The combination set forth in claim 3 further characterized in that said concentric rings are relatively narrow in a radial direction as compared to their axial length to thereby provide rigidity to said end plate but permit free passage of water therethrough.

6. In combination with an outboard motor of the type including a depending support portion provided with a horizontally elongated marine propeller drive housing at its lower end, said depending support portion positioned between a forward and rearward end of said housing, said housing having a front to rear extending shaft journalled therein and a marine propeller mounted on the rear end of said shaft, a weed guard mounted on said rear end of said housing and surrounding and enclosing said propeller, said weed guard comprising a tubular section at its front end and surrounding and embracing said rear end of said housing for detachably securing said tubular section to said housing, said guard also including a rearwardly and radially outwardly diverging tapered wall defining an outer rear edge, said tapered wall comprising a series of radially extending spokes which are relatively thin in circumferential direction as compared to their axial width, whereby water can pass from a front to rear direction readily through said tapered wall, said tapered wall extending radially outwardly and rearwardly at an angle of approximately 120° from the longitudinal front to rear axis of said housing, said guide also including a cylindrical portion integrally connected with said tapered wall at said rear edge, said cylindrical portion disposed radially outwardly from and surrounding said propeller and extending rearwardly past said propeller, said cylindrical portion being perforated so as to be substantially open to permit the passage of water readily therethrough, said tubular section, said tapered wall and said cylindrical portion being an integrally cast and single piece, a removable rear end plate attached to the rear end of said cylindrical portion and extending across said cylindrical portion in a transverse direction, said plate being formed by a series of concentric rings defining a series of arcuate slots circumferentially spaced around and between each adjacent pair of concentric rings, said concentric rings being relatively narrow in a radial direction as compared to their axial length to thereby provide rigidity to said end plate whereby said plate is substantially open to permit free passage of water therethrough, and a rudder extending radially outwardly from said drive housing and terminating at approximately the same radial distance as said cylindrical portion, whereby weeds and the like can slide off said rudder and past said guard.

7. In combination with an outboard motor of the type including a depending support portion provided with a horizontally elongated marine propeller drive housing at its lower end, said depending support portion positioned between a forward and rearward end of said housing, said housing having a front to rear extending shaft journalled therein and a marine propeller mounted on the rear end of said shaft, a weed guard mounted on said rear end of said housing and surrounding and enclosing said propeller, said weed guard comprising a tubular section at its front end and surrounding and embracing said rear end of said housing for detachably securing said tubular section to said housing, said guard also including a rearwardly and radially outwardly diverging tapered wall defining an outer rear edge, said tapered wall comprising a series of radially extending spokes which are relatively thin in circumferential direction as compared to their axial width, whereby water can pass from a front to rear direction readily through said tapered wall, said guide also including a cylindrical portion integrally connected with said tapered wall at said rear edge, said cylindrical portion disposed radially outwardly from and surrounding said propeller and extending rearwardly past said propeller, said cylindrical portion being perforated so as to be substantially open to permit the passage of water readily therethrough, said tubular section, said tapered wall and said cylindrical portion being an integrally cast and single piece, and a removable rear end plate attached to the rear end of said cylindrical portion and extending across said cylindrical portion in a transverse direction, said plate being formed by a series of concentric rings defining a series of arcuate slots circumferentially spaced around and between each adjacent pair of concentric rings whereby said plate is substantially open to permit free passage of water therethrough.

8. The combination set forth in claim 7 further characterized in that said tapered wall extends radially outwardly and rearwardly at an angle of approximately 120° from the longitudinal, front and rear axis of said housing.

9. The combination set forth in claim 7 further characterized in that said arcuate slots between the pairs of adjacent concentric rings are circumferentially off-set from one another.

10. The combination set forth in claim 7 including a rudder extending radially outwardly from said drive housing and terminating at approximately the same radial distance as said cylindrical portion, whereby weeds and the like can slide off said rudder and past said guard.

11. The combination set forth in claim 9 further characterized in that said concentric rings are relatively narrow in a radial direction as compared to their axial length to thereby provide rigidity to said end plate but permit free passage of water therethrough.

* * * * *